United States Patent [19]

Jelfo et al.

[11] 4,065,585

[45] Dec. 27, 1977

[54] RENEWABLE CHOW FUSER COATING

[75] Inventors: Raymond L. Jelfo, Lewisville, Tex.; Stephen Strella, Pittsford; Willard C. Hamilton, Webster, both of N.Y.

[73] Assignee: Xerox Corporation, Stamford, Conn.

[21] Appl. No.: 600,333

[22] Filed: July 30, 1975

Related U.S. Application Data

[62] Division of Ser. No. 487,937, July 12, 1974, Pat. No. 3,934,547.

[51] Int. Cl.[2] ..... B05D 3/12; G03G 13/20

[52] U.S. Cl. ..... 427/11; 427/22; 427/142; 427/194; 427/407 R; 427/409

[58] Field of Search ..... 427/22, 194, 140, 142, 427/11, 407 R, 409; 118/60; 432/60

[56] References Cited

U.S. PATENT DOCUMENTS

| | | | |
|---|---|---|---|
| 3,279,936 | 10/1966 | Forestek | 427/142 X |
| 3,598,631 | 8/1971 | Papst | 427/11 |
| 3,682,689 | 8/1972 | Dueltgen et al. | 96/1 R |
| 3,810,776 | 5/1974 | Banks et al. | 427/194 |
| 3,846,151 | 11/1974 | Roteman et al. | 118/637 X |

*Primary Examiner*—Ronald H. Smith
*Assistant Examiner*—Stuart D. Frenkel

[57] ABSTRACT

A contact fuser assembly for use in an electrostatic reproducing apparatus including an internally heated fuser roll structure comprising a rigid, thermally conductive core which is coated during operation of the assembly with a thin layer of a normally solid thermally stable material with subsequent application of a liquid release agent to the coated core. In the preferred embodiment of the invention the coating material comprises a fluorocarbon telomer such as Vydax 1000 and the liquid release agent comprises a liquid silicone oil.

5 Claims, 3 Drawing Figures

RENEWABLE CHOW FUSER COATING

This is a division of application Ser. No. 487,937, filed July 12, 1974 now U.S. Pat. No. 3,934,547.

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently fix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to thereby result in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface.

A fuser roll construction of the type described above is fabricated by applying in any suitable manner a layer of adhesive material to a rigid core or substrate, such as the Teflon outer surface or covering of the aforementioned arrangement. The application of the layer of Teflon is followed by curing at high temperatures (740° F) and preceded by numerous process steps to prepare the core for the application of the Teflon. Not only is the fabrication process complicated and relatively expensive but the resulting roll structure is subject to degradation due to continued operation at elevated temperatures and also to damage from accidental gouging by stripper fingers conventionally employed in such systems. The foregoing in many instances necessitates replacement of the fuser roll which is quite costly when a large number of machines are involved.

Moreover, since a several mil thickness of polytetrafluoroethylene along with the coating of silicone oil constitutes a thermal barrier, longer nip dwell and higher fuser roll temperatures are required to deliver the fusing energy required. Also, control of the surface temperature of the roll presents a problem due to large temperature variations occurring before and after contacting of the substrate carrying the images.

Accordingly, the principal object of this invention is to provide a new and improved electrostatic copying apparatus.

Another object of this invention is to provide a new and improved fusing apparatus for use in fixing toner images to a copy sheet.

Another object of this invention is to provide, for use in a photocopying apparatus, a fuser that is self-repairing and therefore has a continuously renewable surface.

Still another object of this invention is to provide a new and improved contact fuser wherein an interfacial layer is formed, during the operation of the fuser, intermediate the core surface and a release substance applied thereto whereby offsetting of toner to the core surface is minimized.

Another object of this invention is to provide, in a photocopying apparatus, a fusing device for toner images wherein a coating is formed during operation of the fuser at the interface of a fuser roll core and a release agent.

Still another object of this invention is to provide a new and improved apparatus and method for fusing toner images to a substrate wherein toner barrier and toner release coatings are formed on a thermally conductive core and wherein the combined thickness of the coatings represents a minimal thermal barrier to the energy to be utilized for the core.

BRIEF SUMMARY OF THE INVENTION

Briefly, the above-cited objects are accomplished by the provision of a contact fuser assembly preferably comprising an internally heated roll fuser structure having a rigid thermally conductive core. The fuser assembly as contemplated is utilized for fixing toner images to support sheets by moving the sheets through a nip formed between the fuser roll structure and a deformable backup roll, the fuser roll core and backup roll being supported for rotational movement in a xerographic reproducing apparatus.

Structure is provided adjacent the heated fuser roll core for coating it with a thin layer of normally solid, thermally stable material, for example, a fluorocarbon telomer such as Vydax 1000.

Means for applying a liquid release agent or toner offset prevent material is also positioned adjacent the fuser roll core for applying a thin layer of the release agent, which is preferably silicone oil, to the coated core.

Other objects and advantages of the present invention will become apparent when read in conjunction with the accompanying drawings wherein.

DETAILED DESCRIPTION OF THE PREFERRED EMBODIMENT

Figure 1:
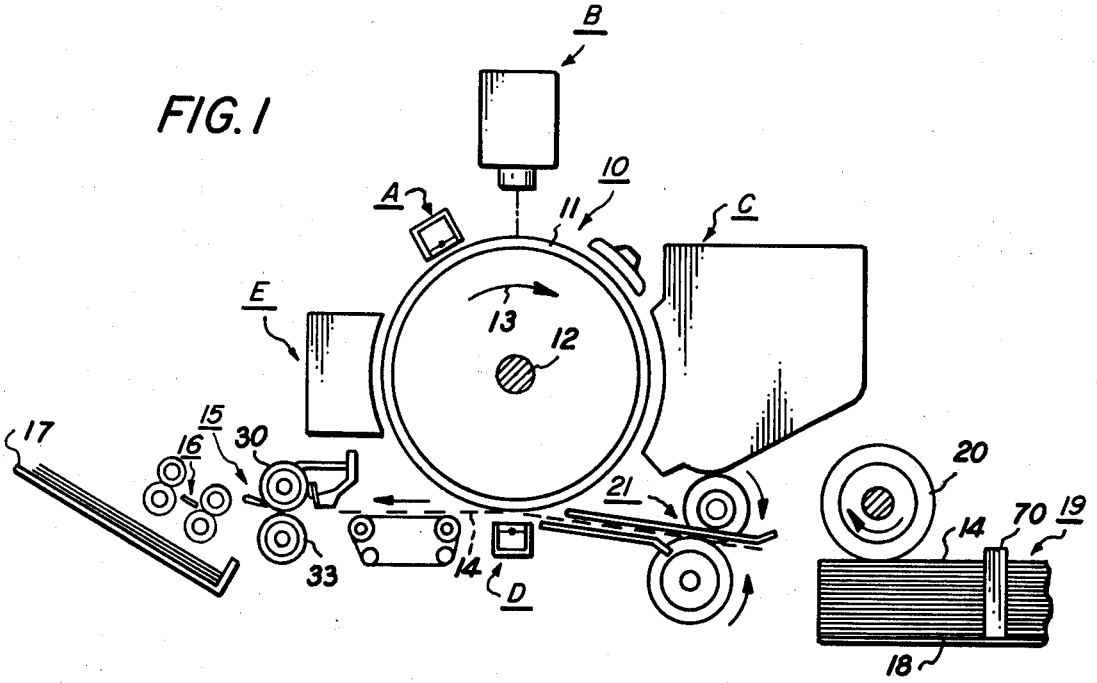
FIG. 1 is a schematic representation of a xerographic reproducing apparatus incorporating the novel contact fuser of this invention.
Figure 2:
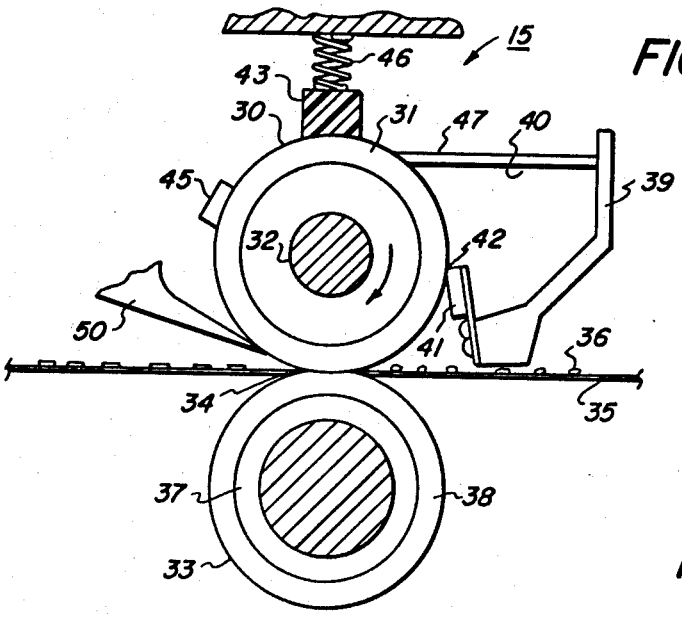
FIG. 2 is a side elevational view of a fuser system incorporated in the apparatus of FIG. 1.
Figure 3:
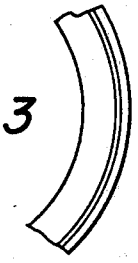
FIG. 3 is a fragmentary view of a fuser roll during operation.

The reproducing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to E. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. patent application, Ser. No. 259,181 filed June 2, 1972.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. patent application, Ser. No. 199,481 filed Nov. 17, 1971. This application describes a magnetic brush development system utilizing a magnetizable developer mix having carrier granules and toner comprising electrophotographic resin plus colorant from dyes or pigments. A developer mix is continually brought though a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support material 14, the sheet with the image thereon is advanced to a suitable fuser assembly 15 which fuses the transfer powder image thereto. After the fusing process, the final support material 14 is advanced by a series of rolls 16 to a copy paper tray 17 for subsequent removal therefrom a machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1972.

The sheets of final support material 14 processed in the automatic xerographic reproducing device may be stored in the machine within a removable paper cassette 18. A suitable paper cassette is set forth in U.S. patent application, Ser. No. 208,138 filed Dec. 15, 1971.

The copier can also have the capability of accepting and processing copying sheets of varying lengths. The length of the copy sheet, of course, being dictated by the size of the original input scene information recorded on the photoconductive surface 11. To this end, the paper cassette 18 is preferably provided with an adjustable feature whereby sheets of varying length and width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

The fuser assembly 15 comprises heated roll structure 30 including a hollow cylinder or core 31 having a suitable heating element 32 disposed in the hollow portion thereof which is co-extensive with the cylinder. The heating element 32 may comprise any suitable type heater for elevating the surface temperature of the heated roll structure to operational temperatures, therefore, 250°–400° F. For example, it may be a quartz lamp. The core 31 is fabricated from any suitable materal capable of accomplishing the objects of the present invention. Typical materials are aluminum and alloys thereof and copper. The resulting structure has an outside diameter on the order of 1.5 to 3.0 inches and has a length on the order of 10 to 15 inches. Power requirements for the foregoing are 500–2500 watts peak power with an average power of 300–2000 watts and 75–250 watts for standby.

The surface temperature of the fuser roll structure may be controlled by contacting the surface thereof with a termistor probe 45 as described in U.S. Pat. No. 3,327,096, issued in 1967 to Bernous and incorporated herein by reference.

The fuser assembly 15 further comprises a backup roll structure 33 which cooperates with the fuser roll structure 30 to form a nip 34 through which a copy paper or substrate 35 passes such that toner images 36 thereon contact the fuser roll structure. The backup roll structure may comprise any suitable construction, for example, a steel cylinder, but preferably comprises a rigid steel core 37 having a Viton elastomer surface or layer 38 thereon. A suitable backup roll has a core approximately 1.8 inches in diameter with a 0.1 inch cover or layer structure of Viton elastomer or other suitable high temperature elastomeric layer structure, for example, silicone rubber and a combination of Viton or silicone rubber with Teflon thereon. Viton is the trademark of Dupont Co. The specific dimensions of the members making up the backup roll will be dictated by the requirements of the particular copying apparatus wherein the fuser assembly 15 is employed, the dimensions being greater or less depending upon the process speed of the machine.

Means (not shown) for applying a loading force in a conventional manner to the fuser assembly 15 serves to create nip pressures on the order of 15 to 150 psi average. The durometer of the backup roll is chosen such that "dwell times" of 5 to 100 milliseconds can be obtained with loading forces within the aforementioned range of pressures. "Dwell time" is proportional to the ratio of the nip length to the surface speed of the rolls. For a given angular velocity the surface speeds will vary depending upon the diameter of the rolls. For example, with a 2 inch fuser roll speeds of 0 to 30 inches per second are attainable and for a 3 inch fuser roll speeds of 0 to 45 inches per second have been attained. Accordingly, it can be seen that the aforementioned "dwell times" can be obtained by varying one or the other or both of the "dwell time" relationships. Durometers of 20–90 Shore A have been found to provide satisfactory results.

The aforementioned materials from which the fuser roll core 31 may be fabricated are relatively high surface energy materials, consequently, hot toner material contacting such surfaces would readily wet the surface of the fuser roll. Accordingly, there is provided a bar of material 43 consisting of a fluorocarbon telomer, for example, Vydax 1000 manufactured by E. I. Dupont. Bias means 46 are provided for urging the bar of Vydax into pressure engagement with the fuser core 31 to thereby effect coating of the core with a layer of Vydax. The bias means is effective to coat the core with a Vydax layer having a lammelar structure which is on the order of 10–10,000 A. It will be appreciated that such a layer cannot withstand abrasion. However, this does not present a problem because the coating is continuously renewed. A sump 39 containing liquid release material 40, preferably 60,000 cp silicone oil, which is applied to the coating 39 is provided for applying a thin layer of silicone oil on the coating 43.

A metering blade 41 preferably of silicone rubber is mounted to the sump 39 by conventional means such that an edge 42 thereof contacts the fuser roll structure and serves to meter the release agent 40 in its liquid state onto the fuser roll. In the preferred embodiment, a blade 0.060 inch thick and having a width of 1.05 inch and length of 15 inches has been employed. By means of such a construction a 0.1–0.5 $\mu$ thickness of release agent is applied to the surface of the fuser roll. The blade 41 also aids in cleaning the fuser roll of toner.

A pair of end seals 47, preferably of sponge rubber, are provided to contain the release agent in the sump 39. One or more stripper fingers 50 are provided for ensuring removal of the substrate from the fuser roll.

The toner that forms the toner images 36 is comprised of an electrophotographic resin plus colorant from dyes and pigments such as carbon black and furnace black. The developer material of which the toner forms a portion may contain cleaning materials and plasticisers in accordance with the desired formulation. Typical toners comprise a copolymerized mixture of styrene or a blend of styrene homologs with 10 to 40% of one or more methacrylate esters selected from the group consisting of ethyl, propyl and butyl methacrylates, as described in U.S. Pat. No. 3,079,342 and incorporated herein by reference.

The effectiveness of a fuser assembly of the type hereinabove described has been demonstrated by buffing Vydax 1000 onto a copper core with subsequent application of silicone oil over the Vydax. The core was heated to a temperature of about 300° to 340° F. during application of the Vydax and the silicone oil. Unfused copy was then passed through a nip formed by the fuser roll structure and a Viton backup roll with the toner images contacting the heated fuser roll structure. Fused copy was obtained without offsetting of toner onto either the paper or the fuser roll structure.

While the invention has been described with respect to a preferred embodiment it will be apparent that certain modifications and changes can be made without departing from the spirit and scope of the invention and is therefore intended that the foregoing disclosure be limited only by the claims appended hereto.

What is claimed is:

1. The method of fusing toner images to support sheets as part of the process of making xerographic reproductions by means of a xerographic reproduction apparatus including the steps of:

rotating a heated thermally conductive core which core is rotatably supported in said reproduction apparatus;

contacting said heated thermally conductive core with a solid low surface energy coating material to form a thin solid coating layer thereon;

subsequently applying a low viscosity liquid release agent to said layer; and passing said support sheets having said toner images adhered thereto into contact with said heated core having said solid coating layer and said release agent thereon such that said toner images contact said release agent and simultaneously applying pressure to said toner images while contacting said heated thermally conductive core with said coating material.

2. The method according to claim 1 wherein said coating material comprises a fluorocarbon telomer and said release agent comprises a relatively low viscosity silicone oil.

3. The method according to claim 1 wherein the application of said silicone oil is carried out on a continuous basis.

4. The method according to claim 3 wherein the contacting of said heated core with said solid low surface energy coating material is carried out on a continuous basis.

5. The method according to claim 4 including contacting the opposite side of said support sheets from that contacted by said core with a backup roll to apply said pressure.

* * * * *